US006516903B2

(12) United States Patent
Rogers

(10) Patent No.: US 6,516,903 B2
(45) Date of Patent: Feb. 11, 2003

(54) DRILL BIT STABILIZER DEVICE

(75) Inventor: Cody H. Rogers, San Angelo, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 10 days.

(21) Appl. No.: 09/739,776

(22) Filed: Dec. 20, 2000

(65) Prior Publication Data

US 2001/0047886 A1 Dec. 6, 2001

Related U.S. Application Data

(60) Provisional application No. 60/190,931, filed on Mar. 21, 2000.

(51) Int. Cl.[7] ..... E21B 4/06
(52) U.S. Cl. ..... 175/300; 175/306; 173/132
(58) Field of Search ..... 175/173, 189, 175/414, 300, 395, 296, 304, 306; 173/132, 133

(56) References Cited

U.S. PATENT DOCUMENTS 3,322,216 A 5/1967 Kurt
4,474,488 A 10/1984 Pinkerton et al.
4,627,626 A * 12/1986 Rohm ..... 279/145
4,727,944 A 3/1988 Bottoms
4,961,469 A 10/1990 Larsson et al.
5,065,827 A 11/1991 Meyers et al.
5,390,749 A 2/1995 Lyon
5,647,447 A 7/1997 Jones
5,699,867 A 12/1997 Jones
5,803,192 A 9/1998 Holte
5,927,411 A * 7/1999 Sheirer ..... 175/417
6,155,361 A * 12/2000 Patterson ..... 175/296

* cited by examiner

*Primary Examiner*—Frank S. Tsay
(74) *Attorney, Agent, or Firm*—Moser, Patterson & Sheridan, L.L.P.

(57) ABSTRACT

A stabilizing sleeve device for an impact drill bit used in underground drilling operations. The cylindrical tubular device has arcuate keys on a bottom edge for interlocking with keyways in the shoulder of a hammer drill bit and a locking key groove in its top edge.

2 Claims, 1 Drawing Sheet

DRILL BIT STABILIZER DEVICE

CROSS-REFERENCE TO RELATED APPLICATION

This application claims the benefit of U.S. Provisional Patent Application Ser. No. 60/190,931, filed Mar. 21, 2000.

BACKGROUND OF THE INVENTION

1. Field of the Invention

The present invention relates generally to drill bits. More specifically, the invention is a stabilizing sleeve for an impact drill bit used in underground drilling operations.

2. Description of the Related Art

The related art of interest describes various drill bit sleeves, but none discloses the present invention. There is a need for a stabilizing sleeve for prolonging the life of the impact drill bit when being used underground. The related art of interest will be discussed in the order of perceived relevance to the present invention.

U.S. Pat. No. 5,065,827 issued on Nov. 19, 1991, to John A. Meyers et al. describes a hammer bit retention tool for a hammer-percussion bit assembly comprising a retaining member or sleeve designed to fit around a modified driver sub and drill bit head. The retainer has an internal distal shoulder adapted to extend around the head section of the bit and functions to grab the severed bit head section upon lifting of the drill string while not interfering with the normal operation of the assembly. An optional pin can be inserted in the retaining member above the internal distal shoulder as an additional securement. The hammer bit retention tool is distinguishable for its modified retaining member with an internal distal shoulder and optional pin structure.

U.S. Pat. No. 5,803,192 issued on Sep. 8, 1998, to Ardis L. Holte describes a drill bit retainer for a down hole hammer assembly. The two-part segmented retainer sleeve comprises an upper ring portion to limit bit travel and an extended lower skirt portion for confinement within a component of the hammer assembly to prevent loss of the retainer sleeve and drill bit in the event of barrel separation. When the chuck unscrews from the barrel, the retainer sleeve will remain in place due to the extended skirt still being radially confined. If the partial separation between the chuck and the barrel, clockwise rotation of the barrel on the chuck will cure the separation. The drill bit retainer is distinguishable for its required halved configuration and the ring and skirt portions.

U.S. Pat. No. 5,647,447 issued on Jul. 15, 1997, and U.S. Pat. No. 5,699,867 issued on Dec. 23, 1997, to William L. Jones describe a bit retention device for a bit and chuck assembly of a down-the-hole percussive drill for retaining the head section of the bit should the head section separate from the shank portion during drilling operations. A wear collar is positioned at the end of the drill string casing and holds the chuck by a peripheral shoulder and an optional pin. The wear collar has a distal inward facing flange which retains a flexible ring. The bit has a retaining shoulder which secures the broken bit from escaping from the wear collar. The wear collar can be rotatable with respect to the chuck. If the wear collar is non-rotatable, the chuck and the wear collar can be a single piece or locked by a pin. The wear collar is distinguishable for its requirement for an inner shoulder, an optional pin, and a flexible retaining ring for the inward facing distal flange. The drill bit must also have a cooperating peripheral retaining shoulder.

U.S. Pat. No. 5,390,749 issued on Feb. 21, 1995, to Leland H. Lyon describes an apparatus for positioning a split retaining ring in a down-hole percussive drill. The positioning apparatus is distinguishable because no protective sheath is provided.

U.S. Pat. No. 4,961,469 issued on Oct. 9, 1990, to Kenneth L. Larsson et al. describes a drill string element for use in top hammer percussive drilling comprising tubes connected by alternating conical threads and cylindrical threads. The drill bit is prevented from falling out of the drill string by a stop ring. The drill string element is distinguishable for lacking a sleeve.

U.S. Pat. No. 4,727,944 issued on Mar. 1, 1988, to Clifford C. Bottoms describes a percussion drill string assembly including a cage threaded to the outer barrel and containing lubricant and steel ball bearings which contact the inner barrel connected to the chuck and drill bit. The cage portion is distinguishable as there is no provision for preventing the loss of a broken drill bit.

U.S. Pat. No. 4,474,488 issued on Oct. 2, 1984, to Cletis P. Pinkerton et al. describes a retainer system for a roof-mine tool bit which is provided with keyway recess portions adapted to telescopingly and/or rotatably receive an interlocking relationship therein correspondingly shaped keyway members carried by the drill steel member. The retainer system is distinguishable for lacking a sheath member.

U.S. Pat. No. 3,322,216 issued on May 30, 1967, to Ewald H. Kurt describes an anvil for a percussive drill having longitudinal notches for interlocking with the chuck grooves or flutes. The anvil element has an outer wear sleeve which is distinguishable for lacking a protective means for preventing loss of a broken drill bit.

None of the above inventions and patents, taken either singly or in combination, is seen to describe the instant invention as claimed.

SUMMARY OF THE INVENTION

The invention is a stabilizing sleeve device for an impact drill bit used in underground drilling operations. It is in the configuration of a cylindrical tubular device with a bottom edge having keys therearound. These keys interlock with keyways in the shoulder of a hammer drill bit. The cylindrical tubular device has a locking key groove in its top edge.

Accordingly, it is a principal object of the invention to provide a stabilizing sleeve device for a drill bit.

It is another object of the invention to provide a stabilizing sleeve device for a drill bit used in underground drilling.

It is a further, object of the invention to provide a cylindrical stabilizing sleeve device having keys on one edge for interlocking with slots on the drill bit.

Still another object of the invention is to provide a cylindrical stabilizing sleeve device having a locking key groove on an opposite edge for fitting the locking key portion of the chuck.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2:
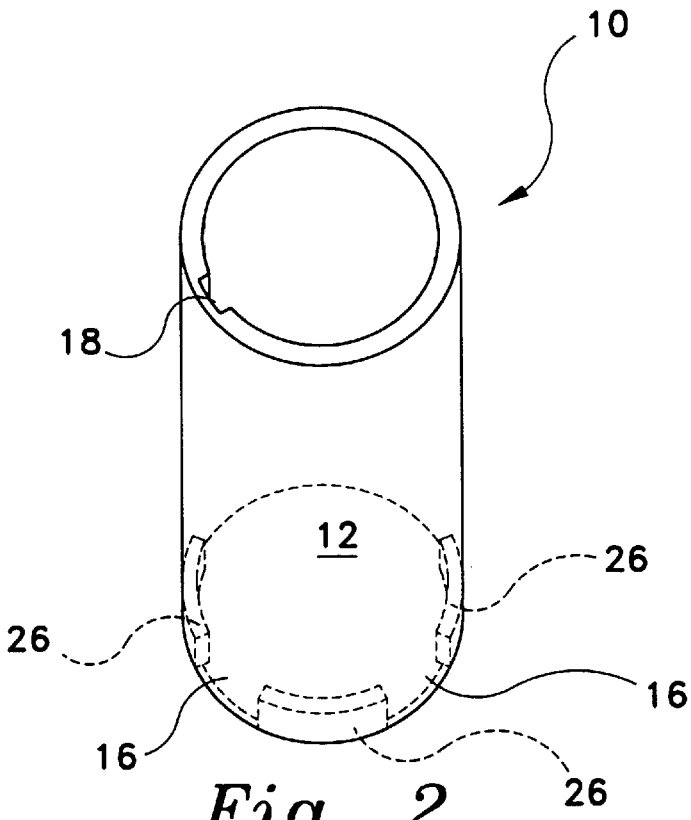
FIG. 2 is a perspective view of the inventive bit stabilizer device.
Figure 3:
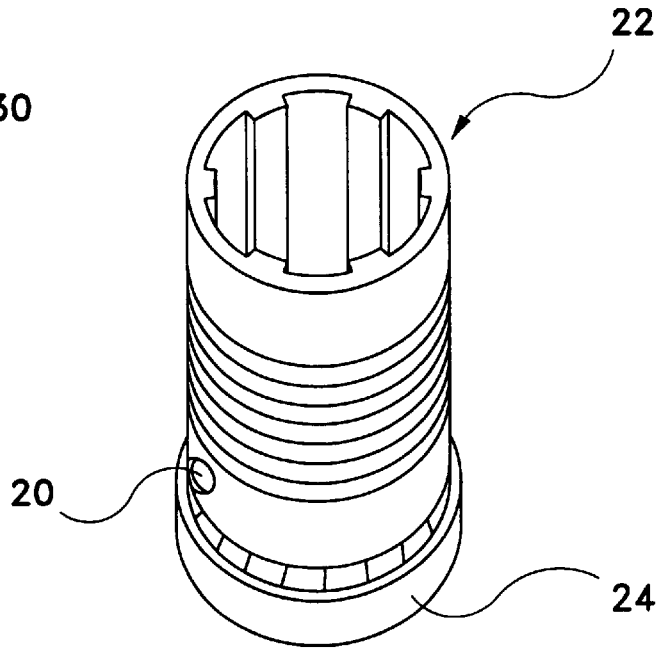
FIG. 3 is a perspective view of a conventional chuck.

The present invention is directed to an impact drill bit stabilizer sleeve device 10 shown in FIG. 2 as comprising a cylindrical metal tube 12 having a top edge and a bottom edge 16. A locking key groove or notch 18 is located on the inside of the top edge for permitting the use of a locking key 20 located in the chuck 22 proximate to the bottom 24 thereof shown in FIG. 3.

Figure 1:
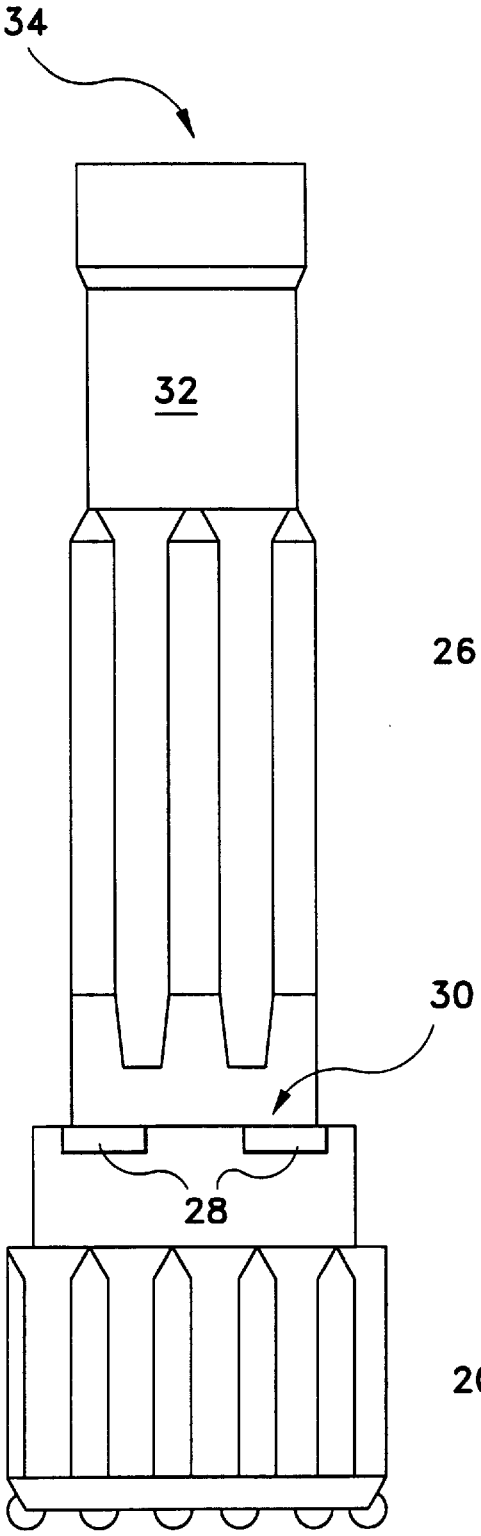
FIG. 1 is a side elevational view of a conventional drill bit with a stabilizer shown in ghost lines, according to the present invention.

The bottom edge 16 of the cylindrical device 10 has three inner indented arcuate keys 26 (FIG. 2) formed for interlocking with the three external arcuate slots or keyways 28 in the shoulder 30 of an underground drill bit head 32 of a hammer bit 34 illustrated in FIG. 1.

After the hammer bit 34 is inserted in the chuck 22, the stabilizer sleeve device 10 is slipped over the chuck and hammer bit to engage the bit's keyways 28 with its keys 26. The stabilizer sleeve device 10 is rotated one-half turn to align the locking key 20 in the chuck 22 with the locking key groove 18 to permit access to the locking key of the chuck. With the chuck 22 threaded into the hammer, the keys 26 of the stabilizer sleeve device 10, interlocked with the keyways 28 of the shoulder 30 of the hammer drill bit 32, stabilize the bottom half of the hammer bit 34 to increase its life and lessen the loss of a broken hammer bit within the downhole.

It is to be understood that the present invention is not limited to the sole embodiment described above, but encompasses any and all embodiments within the scope of the following claims.

I claim:

1. A drill bit stabilizer device system comprising:

a cylindrical metal tube having a top edge and a bottom edge;

said top edge having a locking key groove in an inner surface;

said bottom edge having a plurality of substantially equidistantly spaced arcuate keys in an inner surface; and a shoulder of an underground hammer drill bit head having a plurality of substantially equidistantly spaced arcuate keyways for interfitting the keys in the cylindrical metal tube, for stabilizing a hammer drill bit during a downhole drilling process.

2. The drill bit stabilizer device according to claim 1, wherein the number of keyways and keys is three.

* * * * *